United States Patent [19]

Madderra

[11] 4,385,561

[45] May 31, 1983

[54] LAUNCH TUBE BORE RIDER

[75] Inventor: Jimmy M. Madderra, Huntsville, Ala.

[73] Assignee: The United States of America as represented by the Secretary of the Army, Washington, D.C.

[21] Appl. No.: 230,465

[22] Filed: Feb. 2, 1981

[51] Int. Cl.[3] ..... F42B 13/16

[52] U.S. Cl. ..... 102/523; 89/14 SB; 102/524; 42/76 R

[58] Field of Search ..... 102/520–528; 89/1.8, 1.806, 1.812, 1.816, 14 R, 14 SB; 42/76 R

[56] References Cited

U.S. PATENT DOCUMENTS

| | | | |
|---|---|---|---|
| 2,315,207 | 3/1943 | Janecek et al. | 89/14 SB |
| 3,143,074 | 8/1964 | Jasse | 102/525 |
| 3,430,572 | 3/1969 | Hebert et al. | 102/521 |
| 3,769,912 | 11/1973 | Friend | 102/522 |
| 3,786,760 | 1/1974 | Feldmann | 102/527 |
| 3,946,638 | 3/1976 | Cobb | 89/1.806 |

*Primary Examiner*—Harold J. Tudor

*Attorney, Agent, or Firm*—Nathan Edelberg; Robert P. Gibson; Harold W. Hilton

[57] ABSTRACT

Apparatus for centering the aft end of a missile in a telescoping launch tube including equally spaced bore rider members bonded in the detent groove of a missile at the aft end of the missile. Each bore rider member includes upper and lower portions having a notch therebetween. The bore rider shears at the notch as the rider impacts the inner launch tube ramp. The remaining base is retained in the detent groove and centers the missile in the smaller launch tube as the missile moves along the smaller tube.

2 Claims, 5 Drawing Figures

LAUNCH TUBE BORE RIDER

DEDICATORY CLAUSE

The invention described herein may be manufactured, used, and licensed by or for the Government for governmental purposes without the payment to me of any royalties thereon.

BACKGROUND OF THE INVENTION

In some missile systems the missile is fired from a telescoping launcher/carrier and must transition from a large tube to a small tube. The aft end of the missile is centered and held in the tube by large detents. The detents are expelled at ignition of the rocket motor and, therefore, a centering system is required for the aft end of the missile until it reaches the entrance ramp of the small tube.

In the past, a sabot type of bore rider was used to guide the missile along the tube. The sabot bore rider also served as a restrainer to hold folding fins in place. However, this device was made of cast foam that was large and cumbersome. Additionally, the device disintegrated when it engaged the shoulder of the smaller tube.

SUMMARY OF THE INVENTION

The bore rider of the present invention includes five equally spaced segments bonded in the detent groove at the aft end of the rocket motor. The bore rider includes a lower portion bonded in the detent groove and an upper portion extending out of the detent groove. A notch of predetermined depth separates the upper and lower portions. The bore rider shears at the notch when the extending portion impacts the inner tube. The remaining lower portion provides the same diameter as the bourrelet diameter of the missile warhead.

DESCRIPTION OF THE PREFERRED EMBODIMENT

Figure 2:
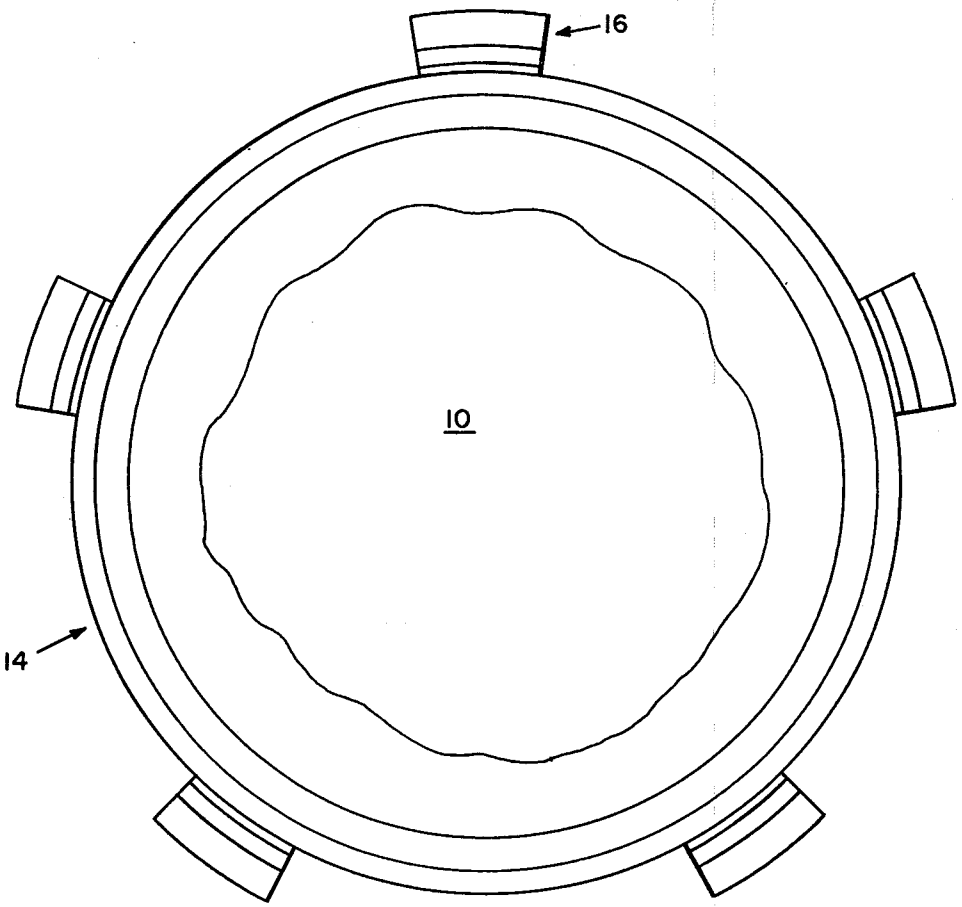
FIG. 2 is an end view of the missile illustrating the spacing of the bore rider members of FIG. 1.
Figure 1:
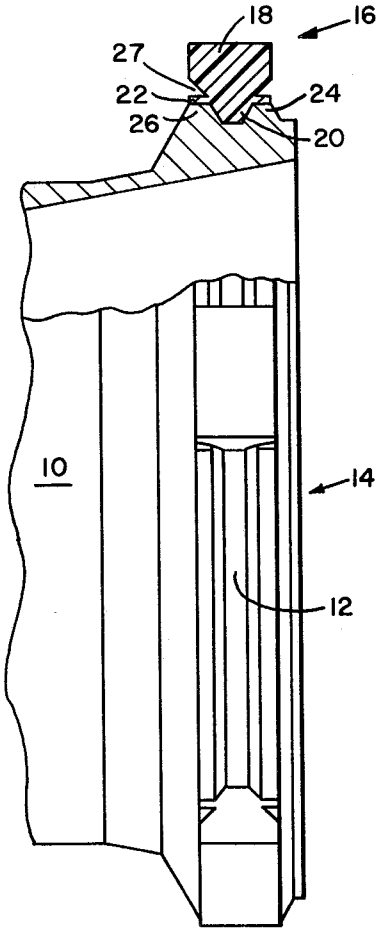
FIG. 1 is an elevational view of a missile having the bore rider members installed in the detent groove of a missile.

As seen in FIG. 1, a missile 10 includes a detent groove 12 at the aft end 14 thereof. A plurality of bore rider members 16 are secured in the detent groove 12. Each bore rider member 16 includes an upper extending portion 18 and a lower bevelled portion 20 secured in detent groove 12. A flanged portion 22 of member 16 extends for engagement with a pair of shoulders 24 and 26 forming detent groove 12. A notch 27 is provided in member 16 adjacent flanged portion 22. As seen in FIG. 2 five of the members 16 are positioned around missile 10.

Figure 3:
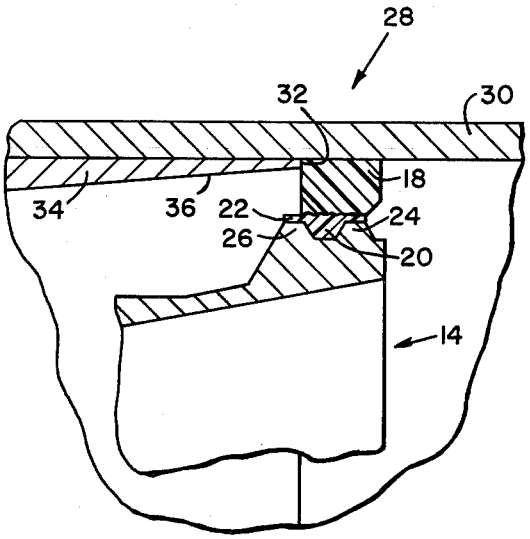
FIG. 3 is an elevational view of the missile in a telescoping launch tube just as the bore rider engages the inner tube.
Figure 4:
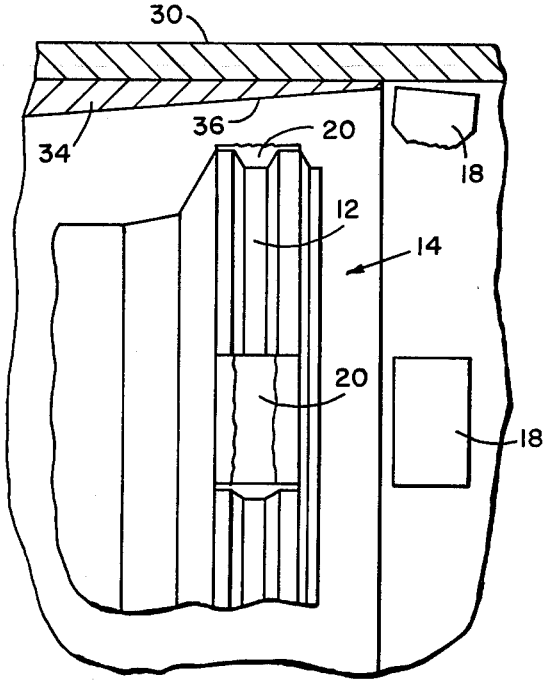
FIG. 4 is a view similar to FIG. 3 showing the missile just after the bore rider has sheared in the transition ramp of the small tube.
Figure 5:
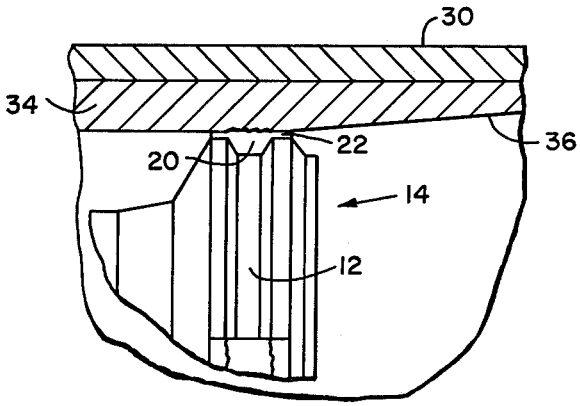
FIG. 5 is a view similar to FIG. 4 showing the missile in the smaller diameter launch tube.

FIGS. 3, 4 and 5 illustrate various positions of the missile in the telescoping launcher/carrier 28.

FIGS. 3 and 4 illustrates the position of missile 10 as the missile leaves the large diameter (outer) tube 30 and member 16 has engaged the shoulder 32 of the smaller diameter (inner) tube 34. As seen in FIG. 3 the bore rider 16 is shearing at notch 27, leaving the lower portion 20 and flange 22 secured in the detent groove. FIG. 4 illustrates the member 16 just after it has sheared and the aft end 14 of the missile is in the transition portion 36 of inner tube 34. FIG. 5 illustsrates the position of the bore rider in the inner tube 34 after the bore rider has sheared at the notch. The bore rider base provides the same diameter for the nozzle as the bourrelet diameter of the warhead and prevents the missile from balloting in the launcher, thereby improving accuracy.

The bore rider material is a synthetic foam material which is stable against aging and temperature variations that is comprised of about 67.3 weight percent of an epoxy resin (EPON 826) prepared from condensing an excess of epichlorohydrin with bisphenol A (diphenlol propane), the epoxy resin is cured with about 8.1 weight percent triethylene-tetramine (T410) and contains a filler material of about 24.6 weight percent of glass bubbles (3M type) to achieve a density of 12 grams per cubic inch for the finished synthetic foam material Each bore rider member is bonded in the detent groove using 3M brand structural adhesive EC2216-B/A.

I claim:

1. In a missile having a detent groove at the aft end and disposed for launching from a telescoping launcher having a pair of launch tubes of different internal diameters, apparatus for centering said missile in said tubes comprising: a member secured in said detent groove, said member including a lower portion bonded in said detent groove and an upper extending portion disposed in engagement with the internal surface of the larger diameter tube, said member further inclining a notch of predetermined depth disposed between said upper and lower portions and a flanged portion disposed between said lower portion and said notch, said flanged portion being bonded to a pair of shoulders forming said detent groove, said member disposed for shearing at said notch responsive to engagement with the shoulder of a smaller diameter tube, said lower portion of said member being retained in said detent groove for engagement with the internal surface of the smaller diameter tube.

2. Apparatus as in claim 1 wherein said member is a synthetic foam material which is stable against aging and temperature variations that is comprised of about 67.3 weight percent of an epoxy resin prepared from condensing an excess of epichlorohydrin with bisphenol A, the epoxy resin being cured with about 8.1 weight percent triethylenetetramine and containing a filler material of about 24.6 weight percent of glass bubbles to achieve a density of 12 grams per cubic inch for the finished synthetic foam material.

* * * * *